US006796848B2

(12) United States Patent
Yu

(10) Patent No.: US 6,796,848 B2
(45) Date of Patent: Sep. 28, 2004

(54) LOW PROFILE ELECTRICAL CONNECTOR

(75) Inventor: Hung-Chi Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/313,113

(22) Filed: Dec. 6, 2002

(65) Prior Publication Data

US 2004/0092171 A1 May 13, 2004

(51) Int. Cl.[7] ..... H01R 24/00
(52) U.S. Cl. ..... 439/676; 439/733.1
(58) Field of Search ..... 439/676, 733.1, 439/941

(56) References Cited

U.S. PATENT DOCUMENTS 4,269,467 A * 5/1981 Hughes ..... 439/344
4,501,464 A 2/1985 Bogese, II
4,904,210 A * 2/1990 Cristescu et al. ..... 439/676
5,791,942 A 8/1998 Patel
6,210,235 B1 4/2001 Wu
6,210,237 B1 4/2001 Chang
6,368,160 B2 * 4/2002 Chang ..... 439/676
6,402,564 B1 * 6/2002 Shi et al. ..... 439/676
6,450,838 B2 * 9/2002 Arnett ..... 439/676
6,659,806 B2 * 12/2003 Shi et al. ..... 439/676

* cited by examiner

*Primary Examiner*—Hae Moon Hyeon
(74) *Attorney, Agent, or Firm*—Wei Te Chung

(57) ABSTRACT

An electrical connector (1) has an insulative housing (10), a shield (20) shielding the housing, and a plurality of terminals (30) received in the housing. Each terminal has a contacting portion (301), a mating portion (302), and a mounting portion (303). The housing has a bottom wall (102) and a rear wall (104). The bottom wall defines a plurality of passageways (107) receiving corresponding mating portions of the terminals. The mounting portions of the terminals abut against a front edge of the bottom wall. The rear wall forms a tab (106) on an inner wall thereof. Free ends of mating portions of the terminals abut against the tab.

6 Claims, 2 Drawing Sheets

LOW PROFILE ELECTRICAL CONNECTOR

BACKGROUND OF THE INVENTION

1. Field of the Invention

The present invention generally relates to an electrical connector, and more particularly to a low profile modular jack used in the transmission of high frequency signals.

2. Brief Description of the Prior Art

Modular jacks are widely used in telecommunication systems for facilitating connection of components thereof. As electrical devices become thinner, electrical connectors should correspondingly become smaller to facilitate development and use of such thin and compact electrical devices.

U.S. Pat. No. 5,791,942 discloses a conventional modular jack. The conventional jack has a dielectric housing and a contact housing part with a first set of rearward facing contacts, a second set of forward facing contacts, and a plurality of associated pin-like terminals respectively received in the contact housing part. The contact housing part, together with the contacts and the terminals, is received in the dielectric housing.

However, the first set of rearward facing contacts and the second set of forward facing contacts have dissimilar configurations, thus complicating their manufacture and inhibiting a reduction in cost. Furthermore, the contacts and the terminals are assembled with the contact housing part before being assembled into the housing. As a result, the jack occupies a larger space, which militates against a more thin and compact electrical device.

Hence, an improved electrical connector having a simplified manufacture and occupying less space is needed to solve the above problems.

BRIEF SUMMARY OF THE INVENTION

It is an object of this invention to provide an electrical connector with a simplified manufacturing process.

It is a further object of this invention to provide an electrical connector which occupies less space.

An electrical connector in accordance with an embodiment of the present invention includes an insulative housing, a plurality of terminals, and a metal shield. Each terminal has a contacting portion, a mating portion bending forwardly and horizontally from the contacting portion, and a mounting portion bending substantially perpendicularly to the mating portion. The housing has a bottom wall, a top wall, side walls and a rear wall. The bottom wall defines a plurality of passageways receiving corresponding mating portions of the terminals. The rear wall forms a tab on an inner wall thereof. Free ends of the terminals abut lightly against the tab, and the mounting portions of the terminals abut against a front edge of the bottom wall.

Other objects, advantages and novel features of the invention will become more apparent from the following detailed description of a preferred embodiment when taken in conjunction with the accompanying drawings.

DETAILED DESCRIPTION OF THE INVENTION

Figure 1:
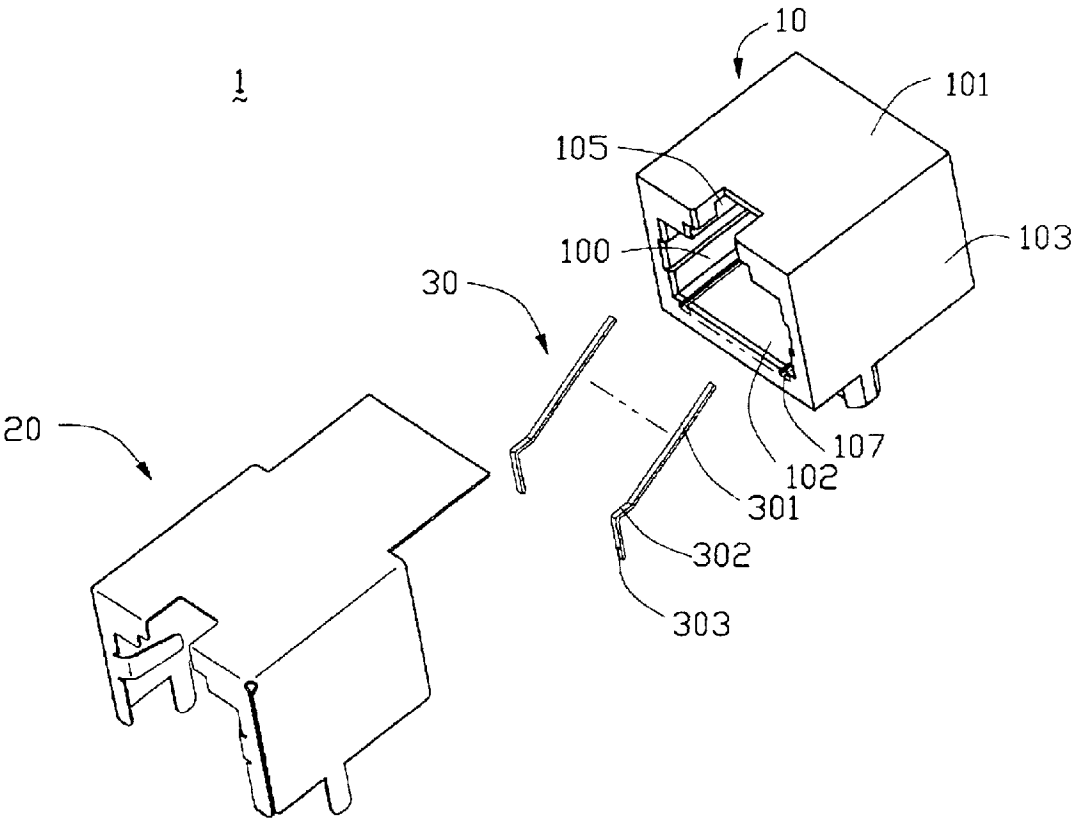
FIG. 1 is an exploded view of an electrical connector of the present invention.

Reference will now be made to the drawing figures to describe the present invention in detail.

Figure 2:
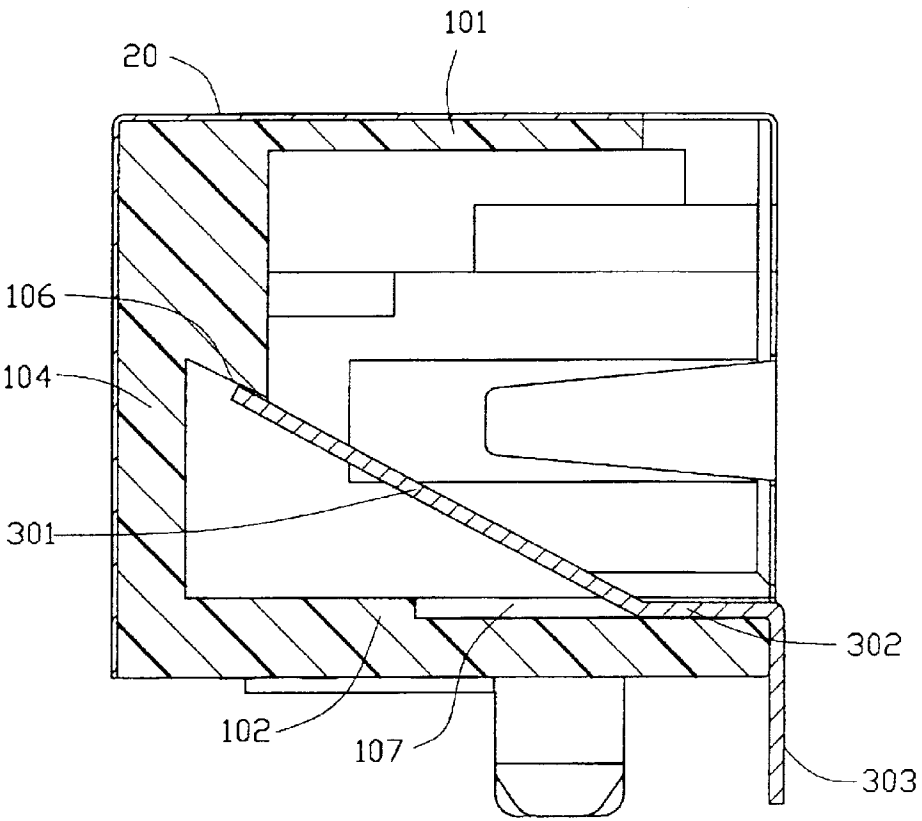
FIG. 2 is a cross-sectional view of an assembled connector of FIG. 1.

Referring to FIGS. 1 and 2, an electrical connector 1 in accordance with a preferred embodiment of the present invention has an insulative housing 10, a plurality of terminals 30 received in the housing 10 and a metal shield 20 formed into a generally cubic configuration.

The housing 10 has a top wall 101, a bottom wall 102, a pair of side walls 103, and a rear wall 104. The top wall 101, the bottom wall 102, the side walls 103 and the rear wall 104 together define a receiving cavity 100 for receiving a complementary plug connector (not shown) therein. The bottom wall 102 defines a plurality of passageways 107 for receiving corresponding terminals 30. The rear wall 104 forms a tab 106 on an inner wall (not labeled) thereof. In addition, the top wall 101 defines a recess 105 at a front edge thereof for engaging with an engaging portion of the complementary plug connector.

Each terminal 30 has a contacting portion 301, a mating portion 302 and a mounting portion 303. The mating portion 302 extends rearwardly from and substantially perpendicularly to the mounting portion 303, and the contacting portion 301 bends rearwardly and upwardly from the mating portion 302. The contacting portion 301 and the mating portion 302 form an obtuse angle between themselves. Each terminal 30 further has a plurality of barbs (not shown) formed respectively on opposite sides of the mating portion 302. The shield 20 has a familiar configuration except that a top side (not labeled) and a rear side (not labeled) thereof are coplanar before the shield 20 is assembled to the housing 10. Since the shield 20 is familiar, a detailed description is omitted herein.

In assembly, the mating portions 302 of the terminals 30 are respectively received in corresponding passageways 107 of the housing 10 with the barbs providing interfering forces between the terminals 30 and corresponding peripheral walls of the passageways 107. The contacting portions 301 of the terminals 30 extend into the receiving cavity 100 of the housing 10 with free ends thereof abutting slightly against the tab 106 of the housing 10. The mounting portions 303 of the terminals 30 abut against a front edge of the bottom wall 102 of the housing. The metal shield 20 surrounds the housing 10, with the rear side thereof being bent downwardly and perpendicular to the top side thereof to cover the rear wall 104 of the housing 10.

In use, positioning posts (not labeled) of the housing 10 and retentive tabs (not labeled) of the shield 20 are mounted into corresponding holes of a printed circuit board (PCB, not shown) to preliminarily position the electrical connector 1. The mounting portions 303 of the terminals 30 are received in corresponding holes of the PCB. When the complementary plug connector is plugged in, the engaging portion thereof engages with the recess 105 of the housing 10, and contacts of the complementary plug connector electrically contact with the terminals 30 of the present electrical connector 1, the terminals 30 distorting flexibly and downwardly. When the complementary plug connector is unplugged from the electrical connector 1, the contacts thereof disconnect from the terminals 30 of the electrical connector 1, and the terminals 30 return to the their original state with the free ends thereof abutting lightly against the tab 106 of the housing 10 again.

The present invention can be explained in other embodiments, one having the housing 10, but with no rear wall 104, and the tab 106 being formed on an inner wall of the top wall 101. Another embodiment can substitute the mounting portions 303 of the terminals 30 for soldering tails that electrically contact with circuit traces on the PCB using surface mounting.

An advantage of the present invention over the prior art results from the fact that the contacting portions 301 of the terminals 30 are bent from the mating portion 302 only once, and the terminals 30 are received in the housing 10 from a front edge of the bottom wall 102 of the housing 10, thus the manufacture process of the terminals 30 and the assembling process are reduced remarkably. Another advantage results from the fact that the terminals 30 are directly received in the housing 10 without any insert module which occupies a large space, thus the size of the electrical connector 1 is relatively less than the conventional connector.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing, the housing having a bottom wall, the bottom wall defining a plurality of passageways; and a plurality of terminals received in corresponding passageways, each terminal having a mounting portion abutting against a front edge of the bottom wall of the housing and downwardly extending beyond the bottom wall along the front edge.

2. The electrical connector of claim 1, wherein each terminals has a mating portion extending rearwardly from and substantially perpendicularly to the mounting portion, and a contacting portion extending from the mating portion.

3. The electrical connector of claim 2, wherein the contacting portion of each terminal bends upwardly and rearwardly from the mating portion.

4. The electrical connector of claim 1, wherein the housing has a rear wall, the top wall forms a tab on an inner thereof, and free ends of the terminals lightly abut against the tab.

5. The electrical connector of claim 1, wherein the housing has a top wall, the top wall forms a tab on an inner wall thereof, and free ends of the terminals slightly abut against the tab.

6. An electrical connector comprising:

an insulative housing defining a cavity in communication with an exterior via a front opening;

a forwardly downwardly oblique tab face formed on a rear portion of the housing downwardly facing the cavity;

a plurality of contacts extending into and disposed in the cavity from the opening, each of said contacts including a mounting portion abutting against a front face of the housing, a mating portion extending from the mounting portion and seated upon a bottom wall of the housing, and a contact portion obliquely diagonally extending from the mating portion and across the cavity with an end abutting against the oblique tab.

* * * * *